United States Patent [19]

Röck

[11] Patent Number: 4,596,062

[45] Date of Patent: Jun. 24, 1986

[54] HINGE

[75] Inventor: Erich Röck, Höchst, Austria

[73] Assignee: Julius Blum Gesellschaft m.b.H., Höchst, Austria

[21] Appl. No.: 527,648

[22] PCT Filed: Dec. 21, 1982

[86] PCT No.: PCT/AT82/00036

§ 371 Date: Aug. 17, 1983

§ 102(e) Date: Aug. 17, 1983

[87] PCT Pub. No.: WO83/02299

PCT Pub. Date: Jul. 7, 1983

[30] Foreign Application Priority Data

Dec. 24, 1981 [AT] Austria ..... 5563/81

[51] Int. Cl.[4] ..... E05G 1/08

[52] U.S. Cl. ..... 16/304; 16/50; 16/288; 16/321; 16/332; 16/366

[58] Field of Search ..... 16/291, 287, 294, 302, 16/363, 374, 375, 333, 322, 300, 292, 296, 325, 341, 50, 332

[56] References Cited

U.S. PATENT DOCUMENTS

| | | | |
|---|---|---|---|
| 760,140 | 5/1904 | McGinness | 16/341 |
| 4,332,056 | 6/1982 | Griffin et al. | 16/341 |
| 4,352,222 | 10/1982 | Mages et al. | 16/287 |
| 4,385,417 | 5/1983 | Röck et al. | 16/288 |

FOREIGN PATENT DOCUMENTS

| | | |
|---|---|---|
| 2749288 | 11/1978 | Fed. Rep. of Germany . |
| 3005609 | 9/1980 | Fed. Rep. of Germany . |
| 1532667 | 6/1967 | France . |

*Primary Examiner*—Donald R. Schran
*Assistant Examiner*—James Wolfe
*Attorney, Agent, or Firm*—Wenderoth, Lind & Ponack

[57] ABSTRACT

A hinge has a catch mechanism including a pressure spring which is arranged in a bush member of plastic material. When the hinge is closed the pressure spring acts through the bush member on a hinge link. A steel pin has a head which rests against a hinge link axle and is provided within the pressure spring.

4 Claims, 8 Drawing Figures

HINGE

BACKGROUND OF THE INVENTION

The invention relates to a hinge with a catch mechanism, a hinge arm fastened to a furniture side-wall being linked by means of two hinge links to a hinge casing or the like fixed to a door, the hinge links being mounted on hinge axles on the hinge arm and in the hinge casing, and one of the hinge links being acted upon by a coil pressure spring pressing against the hinge link by means of an intermediate member arranged between the hinge link and the pressure spring, the intermediate member being a bush member receiving the pressure spring and pivotable around the hinge link axle.

Such hinges are widely used in modern furniture construction, particularly in the construction of modern kitchen furniture. In most cases the catch mechanism in the hinge replaces a separate closing device on the door, e.g. a snapping device, and thus has a favourable effect on the cost of the piece of furniture. Moreover, it prevents the door from remaining open unintentionally when it has been incompletely closed since the catch mechanism pulls the door into its final closed position when the door is within a certain angle to the closing plane.

SUMMARY OF THE INVENTION

It is the object of the invention to provide an improved hinge of the afore-mentioned type and to obtain a still more secure functioning than with prior art hinges having a catch mechanism and to make the production of the hinge more economical.

It is a further object of the invention to design the catch mechanism such that the forces acting thereon can be easily diverted and that the frictional forces acting between the catch mechanism and the other hinge parts are as low as possible.

According to the invention this is achieved by arranging a steel pin in the bush member, which is of plastic material, within the pressure spring, the steel pin having a head positioned between the pressure spring and the hinge link axle around which the bush member is pivotable, and the head having projections laterally resting against such hinge link axle.

An embodiment of the invention provides that the head is of circular shape, when viewed axially hereof.

It is advantageously provided that the projections of the head are crenature-like or that the projections are pyramid-shaped with one corner being directed towards the center of the circle.

To improve the fit of the steel pin, one, preferably two grooves extend in the head of the steel pin, each groove advantageously lying next to the side faces of two projections.

In the following embodiments of the invention will be described in more detail with reference to the drawings without restricting the invention to these embodiments.

DETAILED DESCRIPTION OF PREFERRED EMBODIMENTS

Figures 1, 2, 3, 4:
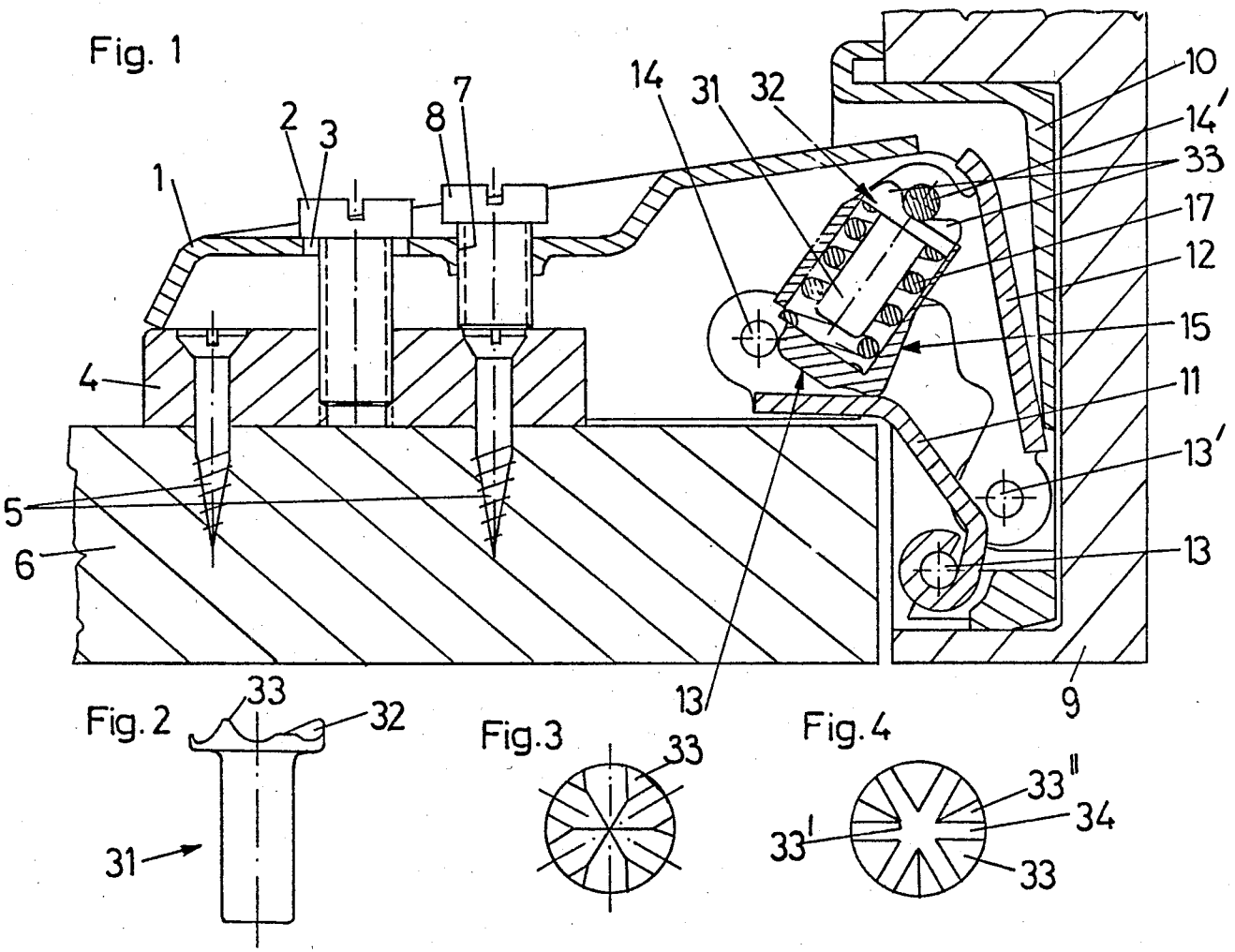
FIG. 1 is a schematic sectional view of a hinge according to the invention and shown in the closed position.
FIG. 2 is a side view of a guide pin of a catch mechanism.
FIG. 3 is a top view of the guide pin.
FIG. 4 is a top view of a further embodiment of a guide pin.
Figure 5:
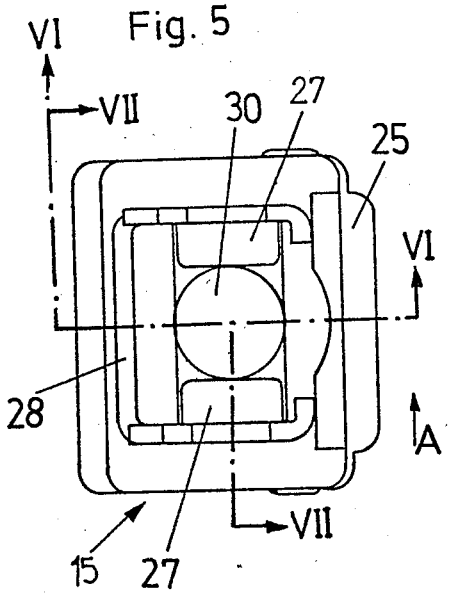
FIG. 5 is a top view of a further embodiment of a bush member.
Figure 6:
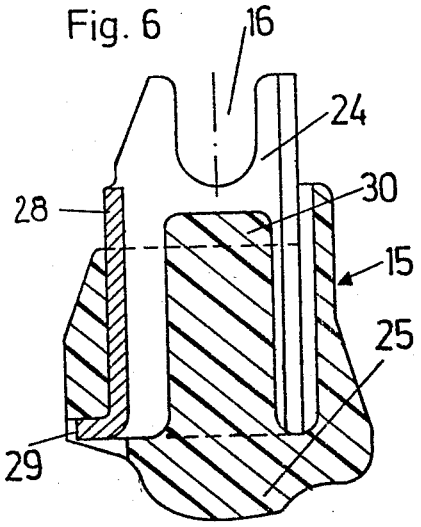
FIG. 6 is a sectional view along line VI—VI of FIG. 5.
Figure 7:
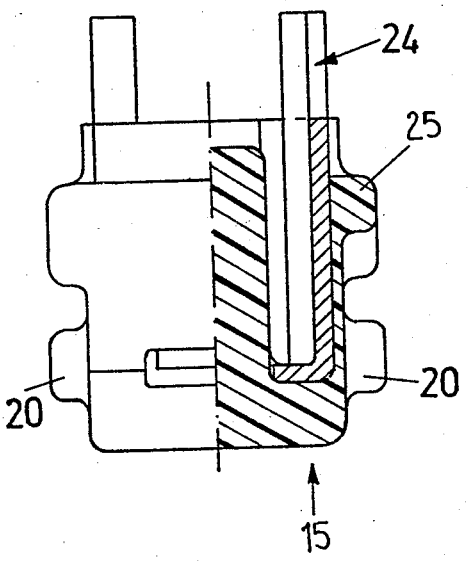
FIG. 7 is a sectional view along line VII—VII of FIG. 5.
Figure 8:
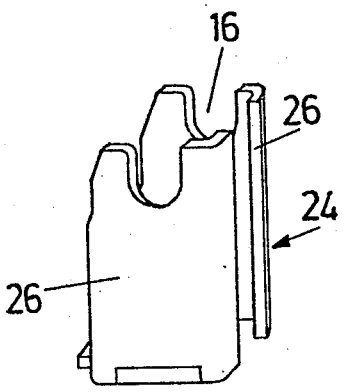
FIG. 8 is a diagrammatic view of the steel insert.

A hinge includes a hinge arm 1 fastened to a mounting plate 4 by means of a fastening screw 2 which extends through a slot 3 in the hinge arm 1. The mounting plate 4 in the illustrated embodiment is screwed to a furniture side-wall 6 by means of screws 5, but any other manner of fastening, e.g. by means of dowels, could be used as well.

An adjusting screw 8 is mounted in a threaded bore 7 of the hinge arm 1, adjusting screw 8 in co-action with the fastening screw 2 permitting an adjustment of the hinge arm 1 and thus of the hinge in the direction of the breadth of the door joint.

A hinge casing 10 is inserted into a recess in a door 9, and the hinge casing 10 and the hinge arm 1 are linked by means of two hinge links 11,12 which are mounted on hinge axles, 13' in the hinge casing and on hinge axles, 14' on the hinge arm 1.

A bush member 15 is arranged between the two hinge links 11,12 and between the two hinge axles, 14' of the hinge arm. In the illustrated embodiment the bush member 15 is mounted by means of projections, to be discussed below, on the respective hinge axle 14 linking the hinge link 12 and the hinge arm 1.

A pressure spring 17 in the form of a coil spring is arranged in the bush member 15. Pressure spring 17, rests, on the one hand, internally against the bush member 15 and, on the other hand, is urged toward the respective the hinge axle 14'. The bush member 15, when the door is open, substantially fully rests against the hinge axle 14 linking the hinge link 11 and the hinge arm 1. Very little or no pressure at all is exerted on the hinge link 11.

When the door 9 is closed (FIG. 1), however, the bush member 15 is directly pressed against the hinge link 11 by the force of the spring 17, and thus holds it in the closed position.

As can be seen from FIG. 1, in this embodiment a steel pin 31 is arranged in the bush member 15, i.e. within the pressure spring 17. The bush member 15 is of plastic material. The steel pin 31 has a circular head 32 which rests against the respective hinge link axle 14' and on which the pressure spring 17 acts. The head 32 has at its side directed towards the respective hinge link axle 14' projections 33 which contact opposite sides of the hinge link axle 14'. Hence, shearing forces occuring at the pressure spring 17 do not act upon the bush member 15 but are diverted through the steel pin 31 via the hinge link axles, 14'.

The projections 33 are, as illustrated in FIG. 4, pyramid-shaped, with corners 33' being directed towards the center of the head 32.

In this embodiment continuous grooves 34 are provided between the projections 33, said grooves extending along the side-walls 33'' of two projections 33.

FIGS. 5 to 8 show an embodiment of a bush member 15 which has, instead of the steel pin, a steel insert 24 and a jacket 25 of plastic material injection-moulded thereto.

In this manner, forces produced by the pressure spring 17 can be better received by the bush member 15. Driving pins 20 can also be moulded on the jacket 25 of plastic material. The guiding pins 20 engage into guide slots or the like in the hinge link 11. The steel insert 24 has two strut members 26 extending along the pressure spring 17.

The strut members 26 of steel are at the lower sides, i.e. at the free end of the bush member 15, provided with angular portions 27. The angular portions 27 are level with the plastic bottom of the plastic jacket 25 so that the pressure spring 17 rests against the angular portions 27.

The steel insert 24 is U-shaped, when viewed from the top, i.e. the strut members 26 are linked by a connecting flange 28. The connecting flange 28, also has an angular portion 29 which projects outwardly and supports the plastic jacket 25.

To obtain better guiding of the pressure spring 17 in the embodiment according to FIGS. 5 to 8 a guide pin 30 is moulded inside the bush member 15 to the bottom of the plastic jacket 25, guide pin 30 being moulded in one piece with the plastic jacket 25 and extending into the pressure spring 17 in the mounted position.

I claim:

1. In a hinge with a catch mechanism for mounting a door of an article of furniture for movement with respect to a side wall of the article of furniture between open and closed positions, said hinge being of the type including a hinge arm adapted to be mounted on the side wall, said hinge arm including a pair of hinge axles, a hinge casing adapted to be mounted on the door, said hinge casing having a pair of hinge axles, a pair of hinge links pivotally mounted to said hinge axles of said hinge arm and to said hinge axles of said hinge casing, a bush member mounted for pivotal movement about a first said hinge axle of said hinge arm, a coil pressure spring within said bush member and biasing said bush member toward a second said hinge axle of said hinge arm, the improvement of means for preventing shearing stresses of said coil spring from acting on said bush member, said means comprising:

a steel pin positioned within said coil spring;

said pin having an integral head positioned between said first hinge axle and said coil spring;

said head having extending therefrom a plurality of projections spaced circumferentially by respective recesses;

each said recess extending radially of said head and aligning with another said recess to form a pair of diametrically aligned recesses; and said head having therein a plurality of said pairs of recesses;

whereby said first hinge axle may be fit in any said pair of recesses with respective said projections extending on opposite sides of said first hinge axle.

2. The improvement claimed in claim 1, wherein said projections and said recesses are of a crenature-like configuration.

3. The improvement claimed in claim 1, wherein said projections are pyramid shaped.

4. The improvement claimed in claim 1, wherein said recesses are formed by diametric grooves formed in said head.

* * * * *